US007963008B2

(12) United States Patent
Yamagishi et al.

(10) Patent No.: US 7,963,008 B2
(45) Date of Patent: Jun. 21, 2011

(54) SLIDER FOR SLIDE FASTENER

(75) Inventors: Koji Yamagishi, Toyama-ken (JP); Hideya Take, Toyama-ken (JP)

(73) Assignee: YKK Corporation (JP)

( * ) Notice: Subject to any disclaimer, the term of this patent is extended or adjusted under 35 U.S.C. 154(b) by 650 days.

(21) Appl. No.: 12/033,161

(22) Filed: Feb. 19, 2008

(65) Prior Publication Data

US 2008/0196218 A1 Aug. 21, 2008

(30) Foreign Application Priority Data

Feb. 20, 2007 (JP) ..... 2007-039776

(51) Int. Cl.
*A44B 19/26* (2006.01)

(52) U.S. Cl. ..... 24/429

(58) Field of Classification Search ..... None
See application file for complete search history.

(56) References Cited

U.S. PATENT DOCUMENTS

| | | | | |
|---|---|---|---|---|
| 1,662,367 | A * | 3/1928 | Draher et al. | 24/429 |
| 1,681,550 | A * | 8/1928 | Marinsky | 24/429 |
| 2,160,160 | A * | 5/1939 | Marinsky et al. | 24/429 |
| 2,160,819 | A * | 6/1939 | Behrens | 24/428 |

FOREIGN PATENT DOCUMENTS

| | | | |
|---|---|---|---|
| DE | 4139480 | A1 | 6/1993 |
| EP | 0280071 | A1 | 8/1988 |
| GB | 1237337 | A | 6/1971 |
| JP | 57099413 | U | 6/1982 |
| JP | 59-80205 | A | 5/1984 |
| JP | 2-98709 | U | 8/1990 |

* cited by examiner

*Primary Examiner* — Jack W. Lavinder
(74) *Attorney, Agent, or Firm* — Kilpatrick Townsend & Stockton LLP

(57) ABSTRACT

The present invention provides a resin-made slider of the type that a pull tab is to be attached afterward, wherein a cantilever pull tab attaching lever is provided from a rear mouth side of an upper blade toward a shoulder mouth and has an engaging portion at a front end portion thereof, an engaged portion is provided on the shoulder mouth of the body so that the engaging and engaged portions can be engaged with each other, a concave portion is provided in the upper blade from a proximal portion toward the shoulder mouth, a gap portion is formed between the upper blade and the proximal portion, and the gap portion allows to form in the upper blade a first upper blade portion separated from the proximal portion and a second upper blade portion disposed from the proximal portion toward the shoulder mouth side and connected to the proximal portion.

6 Claims, 5 Drawing Sheets

SLIDER FOR SLIDE FASTENER

INCORPORATION BY REFERENCE

The present application claims priority under 35 U.S.C. §119 to Japanese Patent Application No. 2007-039776 filed on Feb. 20, 2007. The content of the application is incorporated herein by reference in it's entirety.

BACKGROUND OF THE INVENTION

1. Field of the Invention

The present invention relates to a slider for slide fastener of the type that a pull tab is to be attached afterward, which allows suppliers who deal clothes, bags or the like to easily attach a pull tab of his or her desired design or brand to a slider body made of a resin in which a pull tab attaching lever is formed integrally, the pull tab attaching lever having plasticity.

2. Description of the Related Art

A slider for slide fastener made of a resin, in which a pull tab can be attached to a slider body 101 formed preliminarily, is conventionally known as follows. As shown in FIG. 6, an attaching arm 133 with plasticity is projected in a shape of a cantilever from the top surface of a diamond 104 on a shoulder mouth 108 side of the slider body 101 while an engagement groove 136 having an arrow shaped section is provided at the front end of the arm 133. An engaging piece 122 having an umbrella shaped section is provided on the top surface of an upper blade 102 on a rear mouth 109 side of the body 101, the engaging piece 122 being capable of fitting to the engagement groove 136 provided at the front end of the arm 133. After a shaft portion of the pull tab is inserted through a gap 135 between the front end of the arm 133 and the engaging piece 122, the arm 133 front end is engaged by fitting the engaging piece 122 to the engagement groove 136 so as to close the gap 135, so that the shaft portion of the pull tab cannot be removed from the arm 133.

Another known slider for slide fastener made of a resin, in which a pull tab 230 can be attached afterward, is as follows. As shown in FIG. 7, a pull tab holding frame 233 with plasticity is projected in a shape of a cantilever from the top surface of a diamond 204 on a shoulder mouth 208 side of a body 201 while a hook-shaped portion 218 is formed at the front end of the pull tab holding frame 233. Then, a trapezoidal projection 234 is provided projectingly on the top surface of the upper blade 202 on the rear mouth 209 side of the body 201. A fitting groove 232 is provided from the bottom surface of the projection up to the rear mouth 209 of the slider body 201. After a shaft portion 231 of the pull tab 230 is inserted through a gap 235 between the hook portion 218 and the projection 234, the hook portion 218 engages the projection 234 by fitting the hook portion 218 to the fitting groove 232 so as to close the gap 235, so that the shaft portion 231 of the pull tab 230 cannot escape from the pull tab holding frame 233.

The slider for slide fastener of the type that the pull tab is to be attached afterward shown in FIG. 6 has the following disadvantages. In order to close a fastener chain, the pull tab attached to the pull tab attaching arm 133 is gripped and pulled forward of the slider, that is, toward the shoulder mouth 108 side. In this case, a pulling force is applied from above to the arm 133, so that an action of bringing up the front end of the arm 133, that is, the engaging portion 122 on the rear mouth 109 side of the slider body 101 occurs. Consequently, the rear mouth 109 side of the upper blade 102 of the slider body 101 is brought up, so that a gap between the upper blade 102 and the lower blade 103, that is, a mouth in the slider body 101 is expanded. This inducing a state in which right and left fastener elements do not mesh, namely, chain engagement failure phenomenon occurs. Further, the front end of the arm 133 and the engaging piece 122 are so constructed to engage in the vertical direction of the slider, and no engaging structure is provided in the sideway direction. For this reason, if a lateral pulling force is applied to the arm 133, the front end of the arm 133 slides laterally, thereby providing a concern that the engagement groove 136 and the engaging piece 122 might disengage from each other.

The slider for slide fastener of the type that the pull tab is to be attached shown in FIG. 7 also has the following disadvantages. When the pull tab 230 is operated in a direction of closing the fastener chain by gripping the pull tab 230, an action of raising the front end of the arm is generated by pulling the pull tab 230 upward, so that a mouth between the upper blade 202 and the lower blade 203 is expanded, thereby causing the chain engagement failure phenomenon. When the pull tab 230 is pulled backward of the slider, that is, toward the rear mouth 209 in order to release the fastener chain, a pulling force is applied in an opposite direction to the direction of the hook of the hook portion 218. This causes an action of releasing the engagement between the hook portion 218 and the projection 234. Consequently, the engagement condition might be released, so that the pull tab may slip out from the pull tab holding frame 233, which is a problem to be solved.

SUMMARY OF THE INVENTION

The present invention has been accomplished in views of the above-described problems, and a prominent object of the invention is to provide a made-resin slider for slide fastener of the type that a pull tab is to be attached afterward, wherein even if any tension is applied to a pull tab attaching lever by operating the pull tab, a height dimension of a mouth of a guide groove formed between an upper blade and a lower blade at a rear mouth of the body is prevented from being expanded by providing a gap portion between a proximal portion of the pull tab attaching lever and the rear mouth portion of the upper blade of the body, thereby not inducing the chain engagement failure phenomenon in the slide fastener.

Another object of the present invention is to provide the slider for slide fastener of the type that the pull tab is to be attached afterward, wherein a tension from the pull tab attaching lever is hard to transmit to a portion on the rear mouth side of the upper blade of the body by specifying the configuration for forming the gap portion between the proximal portion of the pull tab attaching lever and the upper blade.

Still another object of the present invention is to provide the slider for slide fastener of the type that the pull tab is to be attached afterward, wherein by specifying the configurations of an engaging portion provided on the front end portion of the pull tab attaching lever and an engaged portion provided on the shoulder mouth side of the body, engagement between the engaging portion and the engaged portion is achieved securely, and further a projecting portion provided on the pull tab attaching lever and a projecting piece provided on the top surface of the body are engaged with each other, so that when the pull tab attached to the pull tab attaching lever is pulled toward the shoulder mouth side of the body, the pulling force is exerted in a direction of bringing the front end portion of the pull tab attaching lever near the body, thereby maintaining the stronger engagement condition.

To achieve the above-described object, according to a first aspect of the present invention, there is provided a resin-made slider for slide fastener of the type that a pull tab is to be attached afterward, comprising: a body in which an upper blade and a lower blade disposed to vertically oppose each other are connected together by a diamond on a shoulder mouth side, that is, on a forward side of the body; and a pull tab attaching lever erected on a top surface of the upper blade of the body, the pull tab attaching lever extending in a shape of a cantilever from a rear mouth side of the body toward the shoulder mouth side. The pull tab attaching lever has a proximal portion projecting upward from the upper blade of the body and a front end portion extending toward the shoulder mouth side of the body at a front end thereof. A concave portion is provided around the proximal portion disposed on the upper blade thereby forming a gap portion between the upper blade and the proximal portion, so that an engaging portion formed at the front end portion and an engaged portion formed on the shoulder mouth side of the body can be engaged with each other.

According to a second aspect of the present invention, there is provided the slider for slide fastener of the type that the pull tab is to be attached afterward, according to the first aspect, wherein the concave portion is continuously formed on both right and left sides and a lower side of the proximal portion and extends from the rear mouth of the body toward the shoulder mouth side, and the proximal portion is connected to the upper blade on the shoulder mouth side.

According to a third aspect of the present invention, there is provided the slider for slide fastener of the type that the pull tab is to be attached afterward, according to the second aspect, wherein the upper blade comprises: a first upper blade portion separated from the proximal portion by the gap portion disposed on both right and left sides and the lower side of the proximal portion; and a second upper blade portion which is disposed on the side of the shoulder mouth with respect to the proximal portion and connected to the proximal portion. The gap portion is also formed on both right and left sides and a lower side of the second upper blade portion.

According to a fourth aspect of the present invention, there is provided the slider for slide fastener of the type that the pull tab is to be attached afterward, according to the first aspect, wherein the engaging portion is formed with a hook portion provided at the front end portion of the pull tab attaching lever, and the engaged portion is projected from the shoulder mouth side of the upper blade of the body while a projecting piece having a hook portion at a front end of the engaged portion is provided to stretch over a top surface of a recess, so that when the engaging portion is engaged with the engaged portion, the hook portion is inserted into the recess formed in a top surface of the diamond.

According to a fifth aspect of the present invention, there is provided the slider for slide fastener of the type that the pull tab is to be attached afterward, according to the fourth aspect, wherein the pull tab attaching lever has a projecting portion formed on a side of the proximal portion with respect to the front end portion, and when the engaging portion is engaged with the engaged portion, the projecting portion is located on the rear mouth side with respect to the projecting piece while opposing the projecting piece in a back and forth direction of the body.

According to a sixth aspect of the present invention, there is provided the slider for slide fastener of the type that the pull tab is to be attached afterward, according to the fifth aspect, wherein the projecting piece has a hook-shaped second engaged portion provided on a surface thereof making contact with the projecting portion, and the projecting portion has a hook-shaped second engaging portion provided on a surface thereof making contact with the projecting piece, so that the second engaged portion and the second engaging portion can be engaged with each other.

Although the pull tab attaching lever is deformed due to distortion relative to the body by an operation of pulling the pull tab attached to the pull tab attaching lever, the upper blade connected to the pull tab attaching lever is never deformed so as to prevent a mouth dimension of a guide groove formed between the upper blade and the lower blade at the rear mouth of the body from being expanded. Consequently, a slider for slide fastener of the type that the pull tab is to be attached afterward, not inducing a condition in which fastener elements fail to engage when the slider is slid, that is, the chain engagement failure phenomenon, can be achieved.

According to the second aspect of the present invention, the concave portion is continuously formed on both right and left sides and a lower side of the proximal portion, and extends from the rear mouth of the body toward the shoulder mouth side, and the proximal portion is connected to the upper blade on the shoulder mouth side. Consequently, in addition to the effect of the first aspect, a tension applied to the pull tab attaching lever is hard to transmit to the upper blade from the right and left sides and the lower side of the proximal portion, thereby preventing deformation of the upper blade on the rear mouth side of the body.

According to the third aspect of the present invention, the upper blade includes a first upper blade portion separated from the proximal portion and a second upper blade portion which is disposed on the side of the shoulder mouth with respect to the proximal portion and connected to the proximal portion, the first and second upper blade portions being formed by a gap portion disposed on both the right and left sides and the lower side of the proximal portion. The gap portion is formed also on both the right and left sides and the lower side of the second upper blade portion. Consequently, in addition to the effect of the second aspect, when a force of trying to pull up the pull tab is applied, the portion of the upper blade on which the force is applied can be disposed at a position nearer the shoulder mouth side of the body with respect to the proximal portion of the pull tab attaching lever, so that a tension is harder to transmit to the upper blade on the rear mouth side of the body.

According to the fourth aspect of the present invention, the engaging portion is formed with a hook portion provided at the front end portion of the pull tab attaching lever, and the engaged portion is projected from the shoulder mouth side of the upper blade of the body while a projecting piece having a hook portion at a front end thereof is provided to stretch over the top surface of a recess, so that when the engaging portion is engaged with the engaged portion, the hook portion is inserted into the recess formed in the top surface of the diamond. Consequently, in addition to the effect of the first aspect, even if a pulling force in the lateral direction is applied to the pull tab attaching lever when the engaging portion and the engaged portion are in engagement, an operation of hook portion's trying to deviate in the right and left direction is blocked by a side wall of the recess, so that the engagement condition is never released.

According to the fifth aspect of the present invention, the pull tab attaching lever has a projecting portion formed on the side of the proximal portion with respect to the front end portion, and when the engaging portion is engaged with the engaged portion, the projecting portion is located on the side of the rear mouth with respect to the projecting piece while opposing the projecting piece in the back and forth direction of the body. Consequently, in addition to the effect of the fourth aspect, when the pull tab is pulled, the shaft portion of the pull tab makes contact with the projecting portion without making contact with the front end portion of the pull tab attaching lever. Accordingly, a rotation force of bringing the front end portion near the body is exerted around a contact point between the shaft portion and the projecting portion, thereby intensifying the engagement between the engaging portion and the engaged portion.

According to the sixth aspect of the present invention, the projecting piece has a hook-shaped second engaged portion provided on a surface thereof making contact with the projecting portion, and the projecting portion has a hook-shaped second engaging portion provided on a surface thereof making contact with the projecting piece, so that the second engaged portion and the second engaging portion can be engaged with each other. Consequently, in addition to the effect of the fifth aspect, because the front end portion of the pull tab attaching lever is engaged with the recess provided concavely in the top surface of the body, engaging means is formed through two stages so that the pull tab attaching lever is fixed to the top surface of the body firmly. As a result, a slider for slide fastener of the type that the pull tab is to be attached afterward, capable of enduring any usage condition, can be achieved. As described above, the advantages which the present invention can exert are remarkable.

DESCRIPTION OF THE PREFERRED EMBODIMENTS

Figure 1:
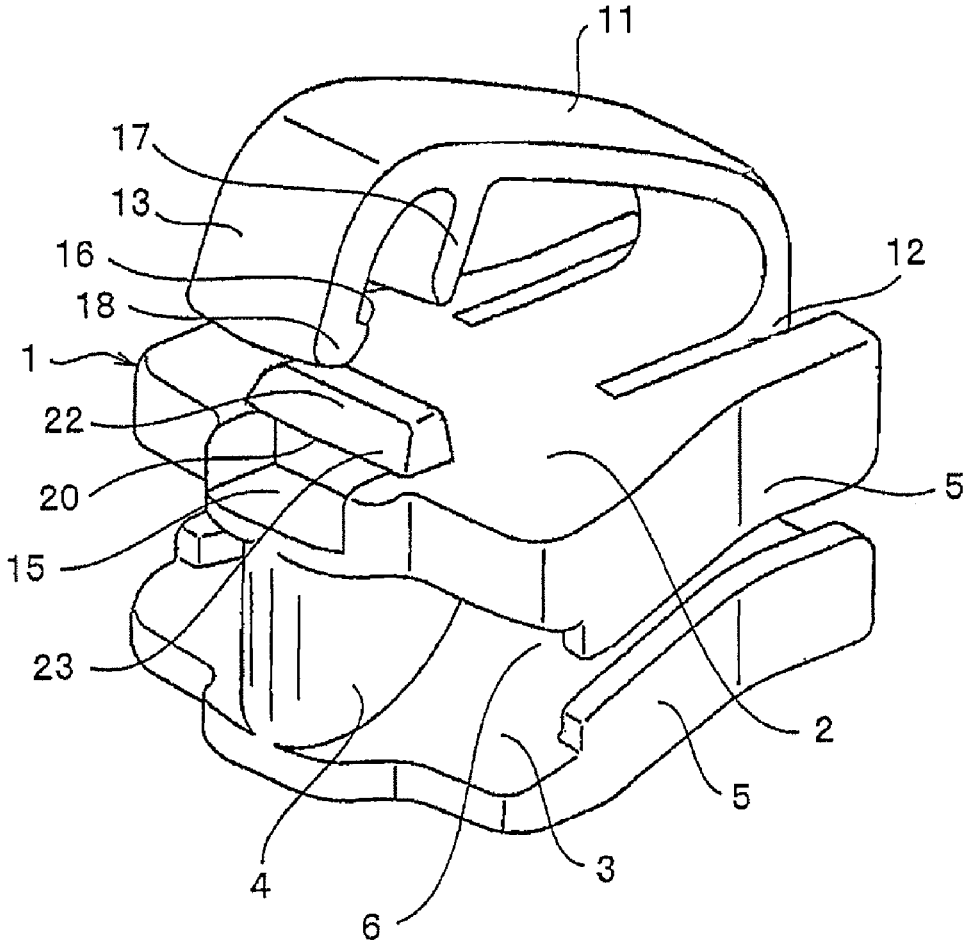
FIG. 1 is a perspective view showing a slider for slide fastener of the type that a pull tab is to be attached afterward, in accordance with a first embodiment of the present invention.
Figure 2:
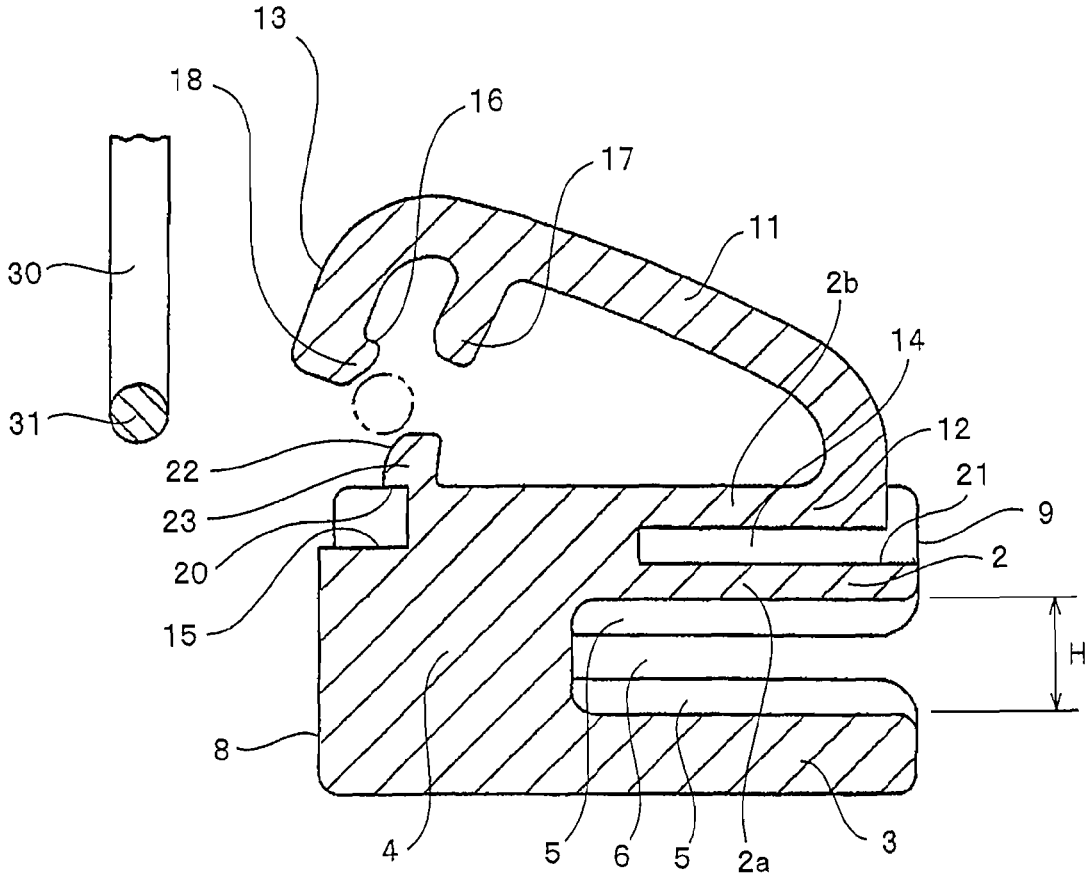
FIG. 2 is a sectional view showing the slider before the pull tab is attached.

A slider for slide fastener of the type that a pull tab is to be attached afterward, according to the present invention, is made of a resin. As shown in FIGS. 1 to 4, the slider has a body 1 and a pull tab attaching lever 11 formed integrally. The body 1 includes a guide groove 6 through which fastener elements can pass. The pull tab attaching lever 11 is erected on the top surface of the body 1, and the pull tab is to be attached to the pull tab attaching lever 11. In the body 1, an upper blade 2 and a lower blade 3, which are disposed to vertically oppose each other with a predetermined gap, are connected by a diamond 4 on a shoulder mouth 8 side, so that the guide groove 6 is formed between the upper blade 2 and the lower blade 3. The pull tab attaching lever 11 is formed in a shape of a cantilever from the rear mouth 9 side of the body 1 toward the shoulder mouth 8 side and includes a proximal portion 12 connected to the upper blade 2 of the body 1 and a front end portion 13 extending from the proximal portion 12. The front end portion 13 is not connected to the body 1 but formed as a free end portion having a gap which allows a shaft portion 31 of a pull tab 30 to be inserted with respect to the top surface of the upper blade 2. The shaft portion 31 of the pull tab 30 is inserted through the gap, and the pull tab 30 is hooked on the pull tab attaching lever 11. Then, the pull tab attaching lever 11 is deformed in the direction of closing the gap by bringing the front end portion 13 near the top surface of the upper blade 2. The front end portion 13 is engaged with the body 1 to allow the pull tab 30 to be attached to the pull tab attaching lever 11 so that the pull tab 30 cannot be removed therefrom.

The proximal portion 12 of the pull tab attaching lever 11 is provided on the top surface of the rear mouth 9 side of the upper blade 2 of the body 1, and a concave portion 21 is formed around the proximal portion 12 of the upper blade 2. Consequently, the upper blade 2 has a first upper blade portion 2*a* separated from the proximal portion 12 and a second upper blade portion 2*b* in which the concave portion 21 is formed on both the right and left sides and the lower side like the proximal portion 12 while the gap portion 14 is formed with respect to the first upper blade portion 2*a*. Formation of the gap portion 14 makes it difficult for a tension applied to the pull tab attaching lever 11 to be transmitted to a portion around the proximal portion 12 of the upper blade 2, that is, the rear mouth side portion when a pulling force is applied to the pull tab 30 attached to the pull tab attaching lever 11, for example, when the slider is slid in the back and forth direction by gripping the pull tab. Consequently, distortion of the pull tab attaching lever 11 is blocked from affecting a mouth dimension H of the guide groove 6 set by the upper blade 2 and the lower blade 3 on the rear mouth 9 side of the body 1.

The concave portion 21 is formed continuously over the right and left sides and a lower side of the proximal portion 12, and a gap portion 14 is formed between the proximal portion 12 and the upper blade portion 2*a* of the upper blade 2. That is, the proximal portion 12 is disposed in the center in the width direction within the concave portion 21 and both the right and left sides of the proximal portion 12 are separated from the upper blade 2 on the lower side while the pull tab attaching lever 11 is connected to the upper blade 2 only on the rear mouth 9 side of the proximal portion 12. Further, the concave portion 21 is extended toward the shoulder mouth 8 side of the body 1 beyond the proximal portion 12, so that the concave portion 21 is formed up to a substantially central position in the back and forth direction of the body 1.

The front end portion 13 of the pull tab attaching lever 11 is disposed opposing the top surface of the upper blade 2 of the body 1 on the side of the shoulder mouth 8, and projected toward the body 1, while an engaging portion 16 having the hook portion 18 which is bent inward, that is, toward the rear mouth 9, is formed at the front end of the front end portion 13. A recess 15 in which the hook portion 18 is to be inserted and accumulated is formed in the top surface of the diamond 4 on a portion on the shoulder mouth 8 side of the body 1 opposing the front end portion 13. The recess 15 has side walls on both the right and left sides such that its forward side of the body 1 is open. An engaged portion 20 is formed at a position of the recess 15 adjacent to the rear mouth 9. The engaged portion 20 includes a projecting piece 22 which projects from the top surface of the upper blade 2 and a hook portion 23 disposed such that it projects from the front end of the projecting piece 22 outward, that is, toward the shoulder mouth 8 side so as to covering the top of the recess 15. When the front end portion 13 of the pull tab attaching lever 11 is deformed in a direction of approaching the body 1, the hook portion 18 of the engaging portion 16 is inserted into the recess 15. When the hook portion 18 is hooked by the hook portion 23 of the engaged portion 20, the engaging portion 16 and the engaged portion 20 engage each other so as to connect the front end portion 13 to the body 1. At this time, both the right and left faces of the hook portion 18 are disposed opposing the right and left side walls of the recess 15. Consequently, even when a tension in the lateral direction is applied to the pull tab attaching lever 11, the position of the front end portion 13 is never deviated in a lateral direction to maintain the engagement between the engaging portion 16 and the engaged portion 20.

The pull tab attaching lever 11 has a projecting portion 17 which projects from a position on the side of the proximal portion 12 with respect to the front end portion 13 and extends toward the top surface of the upper blade 2 of the body 1. The projecting portion 17 is disposed in parallel to the front end portion 13 with a gap. When the engaging portion 16 is engaged with the engaged portion 20, the projecting piece 22 is located between the front end portion 13 and the projecting portion 17. The projecting portion 17 opposes a surface of the projecting piece 22 on the rear mouth 9 side while keeping contact therewith, and presses the projecting piece 22 toward the shoulder mouth 8 side so as to urge the hook portion 23 in a direction of being hooked by the hook portion 18. That is, the projecting piece 22 is sandwiched by the front end portion 13 and the projecting portion 17 in the back and forth direction of the body, so that the engagement condition between the engaging portion 16 and the engaged portion 20 is intensified. When the pull tab 30 is gripped and pulled, the projecting portion 17 comes into contact with the shaft portion 31 of the pull tab 30, so that a rotation force of front end portion 13's trying to approach the body 1 with a contact point between the shaft portion 31 and the projecting portion 17 acting as a center is generated. Accordingly, an operation of the hook portion 18 and the hook portion 23 making firm contact with each other is exerted, thereby maintaining the engagement between the engaging portion 16 and the engaged portion 20 firmly.

First Embodiment

As shown in FIGS. 1 to 4, a slider for slide fastener of the type that a pull tab is to be attached afterward, in accordance with a first embodiment of the present invention, includes a body 1 and a pull tab attaching lever 11 provided on the top surface of the body 1. The body 1 and the pull tab attaching lever 11 are molded with a thermoplastic resin such as polyacetal, polyamide, polypropylene, or polybutylene terephthalate by injection molding means. As for the configuration of the body 1 of the slider, an upper blade 2 and a lower blade 3, which are disposed opposing vertically, are connected by a diamond 4 on a shoulder mouth 8 side, that is, on the front end side of the body 1, and flanges 5 are provided on both sides of the upper blade 2 and the lower blade 3 such that they project toward the lower blade 3 or the upper blade 2. The guide groove 6 is formed within the slider so as to be surrounded by the upper blade 2, the lower blade 3, the diamond 4 and the flanges 5. With fastener elements passing through the guide groove 6, when the slider is slid along the fastener elements, the fastener elements can be engaged or disengaged.

The pull tab attaching lever 11 is erected from the top surface of the upper blade 2 of the body 1. A proximal portion 12 of the pull tab attaching lever 11 is projected from a rear mouth 9 side of the body 1, that is, the rear end side while its front end 13 is formed in a shape of a cantilever so as to be extended toward the shoulder mouth 8 side of the body 1. A concave portion 21 is continuously formed in the upper blade 2 at portions located on both right and left sides and the lower side with respect to the proximal portion 12 of the pull tab attaching lever 11. The concave portion 21 is extended from the rear mouth 9 side toward the shoulder mouth 8 side of the body 1 up to a substantially central position in the back and forth direction of the body 1, and a gap portion 14 which is a hollow portion is formed between the proximal portion 12 and the concave portion 21. The upper blade 2 on the rear mouth 9 side has the following configuration by the gap portion 14. Specifically, the upper blade 2 is divided into a first blade portion 2*a* which is disposed on both the right and left sides and the lower side with respect to the proximal portion 12 and separated from the proximal portion 12, and a second upper blade portion 2*b* which is disposed on the side of the shoulder mouth 8 side with respect to the proximal portion 12 and jointed to the proximal portion 12. Provision of the gap portion 14 blocks a pulling force applied to the pull tab attaching lever 11 from being transmitted to the rear mouth 9 of the upper blade 2. Accordingly, the upper blade 2 is never distorted and a height dimension H between the upper blade 2 and the lower blade 3 at the rear mouth 9, that is, a mouth dimension of the guide groove 6 is never expanded.

On the other hand, the front end portion 13 of the pull tab attaching lever 11 is projected from the bottom surface of the pull tab attaching lever 11 toward the diamond 4 of the body 1, and a hook portion 18 is provided so as to be bent inward, that is, toward the proximal portion 12, so that the hook portion 18 constitutes an engaging portion 16. The hook portion 18 can be inserted into a recess 15 formed above the diamond 4, that is, in an end portion on the shoulder mouth 8 side of the body 1. A projecting piece 22 having a hook portion 23 projecting outward, that is, toward the shoulder mouth 8 side of the body 1 is formed at a position adjacent to the rear mouth 9 side with respect to the recess 15, and the hook portion 23 constitutes an engaged portion 20 capable of engaging the engaging portion 16. A projecting portion 17 is provided in parallel to the front end portion 13 at a position inside of the front end portion 13 of the pull tab attaching lever 11, that is, on the side of the proximal portion 12 with respect to the front end portion 13, thereby pressing the projecting piece 22 from the back side thereof, that is, from the central side of the body 1, so that the projecting piece 22 is sandwiched between the front end portion 13 and the projecting portion 17. When the slider is moved forward of the body 1, a shaft portion 31 of a pull tab 30 inserted into the inside of the pull tab attaching lever 11 is received by the projecting portion 17. This receiving operation generates an action that the hook portion 18 provided on the front end portion 13 of the pull tab attaching lever 11 deeply enters the recess 15 provided in the body 1, thereby enabling the engaging portion 16 and the engaged portion 20 to be engaged firmly. The hook portion 18 on the front end portion 13 of the pull tab attaching lever 11 is blocked from being deviated in the right and left direction by the presence of both the right and left side walls of the recess 15. Consequently, even if the pull tab attaching lever 11 is pulled in the lateral direction, the engagement condition between the engaging portion 16 and the engaged portion 20 is maintained.

The recess 15 is formed by cutting out an upper portion of the diamond 4 such that its front face, that is, a surface on the shoulder mouth 8 side is open. Because this portion is the thickest portion in the vertical direction of the body 1, formation of the recess 15 does not extremely reduce the strength of the body 1. Further, when the front end portion 13 is deformed in the direction of approaching the body 1, the hook portion 18 becomes easy to enter the recess 15. The projecting piece 22 is disposed above the rear face of the recess 15, that is, a surface of the recess 15 on the rear mouth 9 side. The hook portion 23 formed on the bottom surface of the projecting piece 22 is provided projectingly so as to cover the top of the recess 15 while being stretched to stride between the right and left side walls of the recess 15. As a result, the hook portion 23 is connected to the top surface of the upper blade 2 around the recess 15 on the rear mouth 9 side and both the right and left sides, thereby providing a rigid structure. The recess 15 has a space large enough for accommodating the hook portion 18 in the back and forth direction of the body 1. When the hook portion 18 enters the recess 15, the front face of the front end portion 13 and the front face of the diamond 4 can be positioned on an identical vertical plane. Consequently, the front end portion 13 never projects forward of the front face of the diamond 4, thereby eliminating a trouble of the front end portion 13's being caught by other thing and then, a slide having an excellent appearance being finished.

Figure 3:
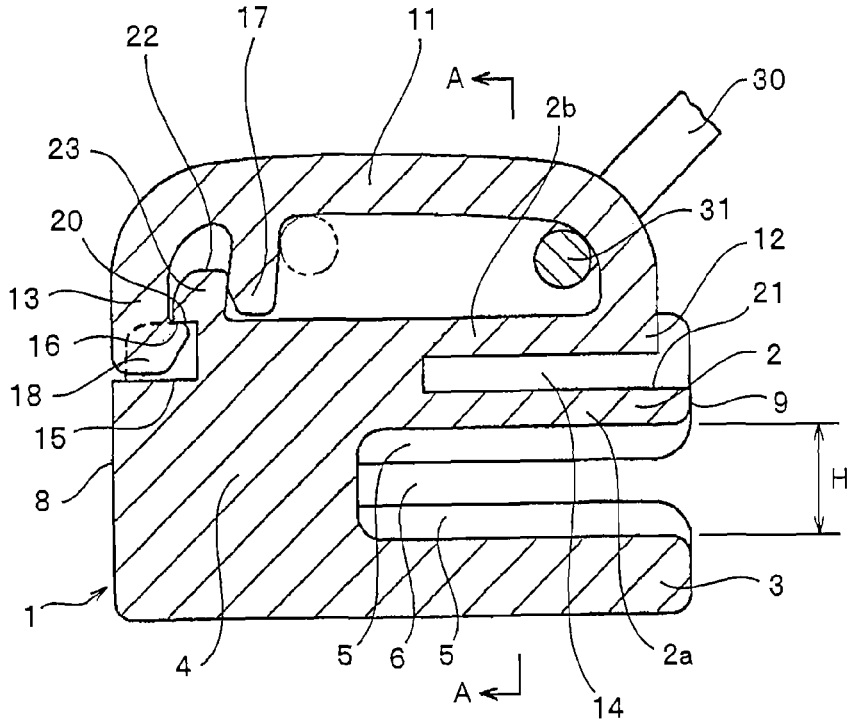
FIG. 3 is a sectional view showing the slider after the pull tab is attached.
Figure 4:
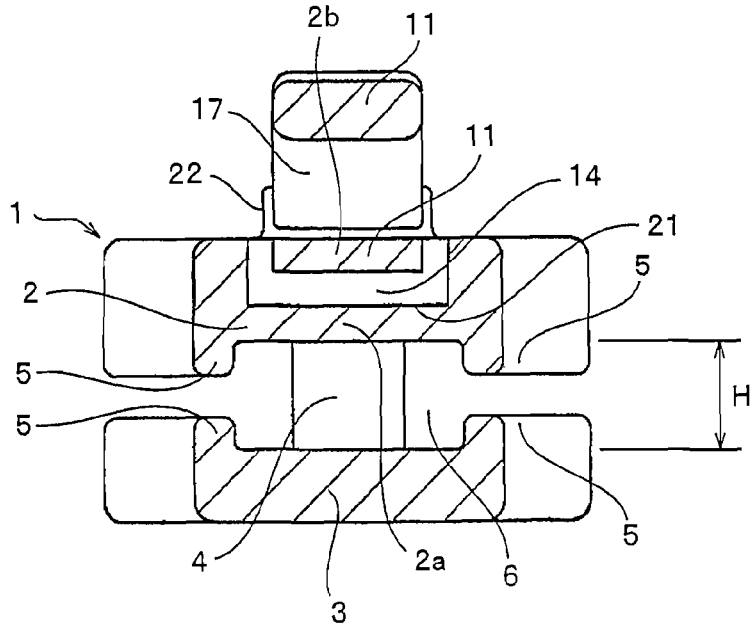
FIG. 4 is a sectional view showing the slider, taken along line A-A in FIG. 3.

Upon attaching the pull tab 30 to a completed slider of the type that the pull tab is to be attached afterward, a gap which allows the shaft portion 31 of the pull tab 30 to be inserted is provided between the front end portion 13 of the pull tab attaching lever 11 and the projecting piece 22 formed on the top surface of the diamond 4 of the body 1 before the pull tab 30 is attached. Then, the shaft portion 31 of the pull tab 30 is inserted to the inside of the pull tab attaching lever 11 from the shoulder mouth 8 side of the body 1 using this gap. Thereafter, as shown in FIG. 3, the hook portion 18 provided on the front end portion 13 is engaged with the engaged portion 20 having the hook portion 23 provided on the projecting piece 22 stretched over the recess 15 formed in the body 1 by pressing the pull tab attaching lever 11 from above. Consequently, the gap is closed thereby to block the pull tab 30 from being removed from the pull tab attaching lever 11.

When the slider equipped with the pull tab 30 is slid in a direction of closing the fastener chain, that is, toward the shoulder mouth 8 side of the body 1 as shown in FIG. 3, the shaft portion 31 of the pull tab 30 comes into contact with the proximal portion of the projecting portion 17 as indicated with two dots and dash line in the figure. When the pull tab attaching lever 11 is pulled obliquely upward, a rotation force of trying to bring the front end portion 13 of the pull tab attaching lever 11 near the body 1 is generated around a contact point between the projecting portion 17 and the shaft portion 31. Consequently, deformation of the front end portion 13 is generated so as to bring the hook portion 18 provided on the front end portion 13 of the pull tab attaching lever 11 into the recess 15 of the body 1 deeply to the rear mouth 9 side, so that the engaging portion 16 is engaged firmly with the engaged portion 20. When the slide is slid in a direction of disengaging the fastener chain, that is, toward the rear mouth 9 side of the body 1 shown in FIG. 3, the shaft portion 31 of the pull tab 30 pulls the pull tab attaching lever 11 backward obliquely upward, so that the pull tab attaching lever 11 is distorted slightly upward. However, the engagement between the engaging portion 16 and the engaged portion 20 is never released because the projecting piece 22 is sandwiched by the front end portion 13 and the projecting portion 17 in the back and forth direction. Further, the mouth dimension H between the upper blade 2 and the lower blade 3 on the rear mouth 9 side of the body 1 is never affected accompanied by the upward distortion of the pull tab attaching lever 11, thereby separating the fastener chain to the right and left smoothly.

Second Embodiment

Figure 5:
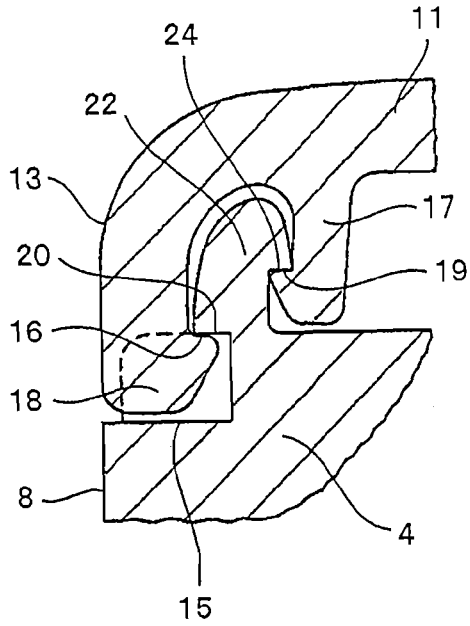
FIG. 5 is a sectional view of major portions, showing a body of the slider and a part of a pull tab attaching lever in accordance with a second embodiment of the present invention.
Figure 6:
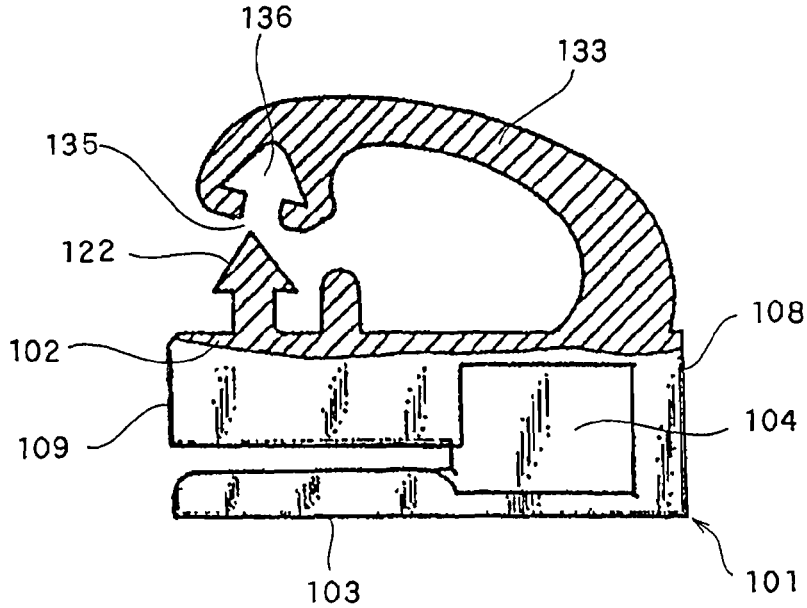
FIG. 6 PRIOR ART
FIG. 6 is a front view showing a known slider before a pull tab is attached, with its body partially cut.
Figure 7:
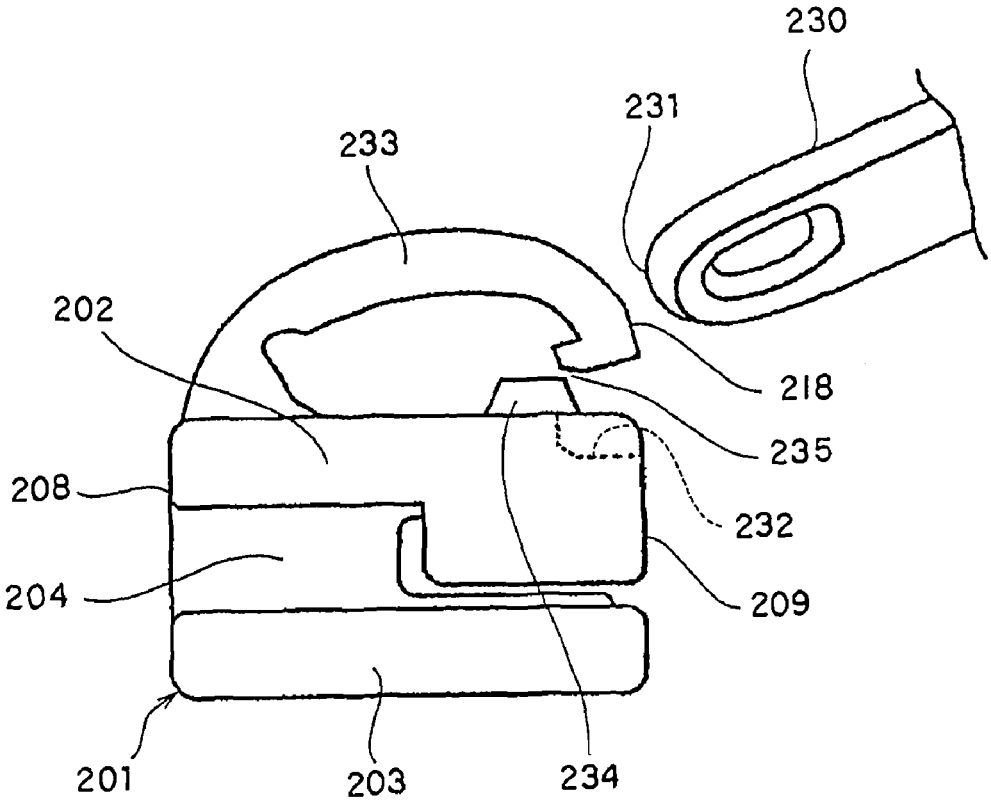
FIG. 7 PRIOR ART
FIG. 7 is a front view showing a body and a pull tab of another known slider before the pull tab is attached.

A slider for slide fastener of the type that a pull tab is to be attached afterward, in accordance with a second embodiment shown in FIG. 5, is invented by improving the projecting portion 17 of the pull tab attaching lever 11 and the projecting piece 22 formed on the top surface of the diamond 4 in the slider shown in the first embodiment. Other configuration is the same as that of the slider of the first embodiment. If speaking of the second embodiment, a hook portion 18 facing inward is provided at a front end portion 13 of the pull tab attaching lever 11, and an engaging portion 16 is formed on the top surface of the hook portion 18. Then, the projecting portion 17 disposed in parallel to the front end portion 13 is projected from the pull tab attaching lever 11, and the projecting piece 22 provided on the top surface of the diamond 4 is sandwiched by the front end portion 13 and the projecting portion 17.

On the other hand, a recess 15 is provided in the top surface of the diamond 4 by cutting out the front face of the diamond 4, and the projecting piece 22 having a hook portion 23 at its front end is provided projectingly at a position adjacent to the recess 15 on the side of the rear mouth 9, thereby forming an engaged portion 20 on the bottom surface of the hook portion 23. The hook portion 18 provided on the front end portion 13 of the pull tab attaching lever 11 is inserted into the recess 15 so as to allow the engaging portion 16 to be engaged with the engaged portion 20. At this time, the hook portion 18 is blocked from being deviated in the right and left direction by both the right and left side walls of the recess 15.

A second engaging portion 19 projecting in a shape of a hook is provided on a surface of the front end of the projecting portion 17 on a side making contact with the projecting piece 22, and a second engaged portion 24 projecting in a shape of a hook is provided on a surface of the projecting piece 22 on a side making contact with the projecting portion 17, that is, a surface of the projecting piece 22 on an opposite side to the face provided with the hook portion 23. Then, the second engaging portion 19 are engaged with the second engaged portion 24 for fixing. When a shaft portion 31 of a pull tab 30 comes into contact with the proximal portion of the projecting portion 17, the second engaging portion 19 of the projecting portion 17 is engaged firmly with the second engaged portion 24 of the projecting piece 22. At the same time, the engaged portion 20 formed on the projecting piece 22 and the engaging portion 16 at the front end portion 13 engage firmly because the hook portion 18 provided on the front end portion 13 enters the recess 15 provided in the top surface of the diamond 4 deeply. Therefore, the body 1 and the pull tab attaching lever 11 are fixed together rigidly by the engaging portions provided at the two positions, so that the slider can be slid smoothly even if the pull tab 30 is pulled from any direction.

According to the slider for slide fastener of the type that the pull tab is to be attached afterward in accordance with the present invention, suppliers who deal with clothes, bags or the like attach pull tabs of their desired design or brand to fastener chains freely and easily for themselves or attach the pull tabs to sliders not yet equipped with those so as to complete their products for sale.

What is claimed is:

1. A slider for slide fastener made of a resin, comprising:

a body in which an upper blade and a lower blade disposed to vertically oppose each other are connected together by a diamond on a shoulder mouth side; and a pull tab attaching lever erected on a top surface of the upper blade of the body, the pull tab attaching lever extending in a shape of a cantilever from a rear mouth side of the body toward the shoulder mouth side, wherein the pull tab attaching lever has a proximal portion projecting from the upper blade of the body and a front end portion extending toward the shoulder mouth side of the body, and a concave portion is provided around the proximal portion disposed on the upper blade thereby forming a gap portion with respect to the upper blade, so that an engaging portion formed at the front end portion and an engaged portion formed on the shoulder mouth side of the body can be engaged each other.

2. The slider for slide fastener according to claim 1, wherein the concave portion is continuously formed on both right and left sides and a lower side of the proximal portion and extends from the rear mouth of the body toward the shoulder mouth side, and the proximal portion is connected to the upper blade on the rear mouth side.

3. The slider for slide fastener according to claim 2, wherein the upper blade comprises: a first upper blade portion separated from the proximal portion by the gap portion disposed below a lower side of the proximal portion; and a second upper blade portion which is disposed on the side of the shoulder-mouth with respect to the proximal portion and connected to the proximal portion, and the concave portion is also formed on both right and left sides and a lower side of the second upper blade portion.

4. The slider for slide fastener according to claim 1, wherein the engaging portion is formed with a hook portion provided at the front end portion of the pull tab attaching lever, and the engaged portion is projected from the shoulder mouth side of the upper blade of the body while a projecting piece having a hook portion at a front end thereof is provided to stretch over a top surface of a recess, so that when the engaging portion is engaged with the engaged portion, the hook portion is inserted into the recess formed in a top surface of the diamond.

5. The slider for slide fastener according to claim 4, wherein the pull tab attaching lever has a projecting portion formed on a side of the proximal portion with respect to the front end portion, and when the engaging portion is engaged with the engaged portion, the projecting portion is located on the rear mouth side with respect to the projecting piece while opposing the projecting piece in a back and forth direction of the body.

6. The slider for slide fastener according to claim 5, wherein a hook-shaped second engaged portion is provided on a surface of the projecting piece of the engaged portion making contact with the projecting portion, and a hook-shaped second engaging portion is provided on a surface of the projecting portion making contact with the projecting piece, so that the second engaged portion and the second engaging portion can be engaged with each other.

* * * * *

UNITED STATES PATENT AND TRADEMARK OFFICE

CERTIFICATE OF CORRECTION

PATENT NO. : 7,963,008 B2
APPLICATION NO. : 12/033161
DATED : June 21, 2011
INVENTOR(S) : Koji Yamagishi et al.

It is certified that error appears in the above-identified patent and that said Letters Patent is hereby corrected as shown below:

In column 1, line 55, after "frame 233" insert -- Patent document 1: Japanese Utility Model Application Laid-Open No. 2-98709 Patent document 2: Japanese Patent Application Publication No. 3-31441 --.

In column 6, line 14, after "upper blade 2.", insert -- The concave portion 21 is formed continuously over the right and left sides and a lower side of the proximal portion 12, and a gap portion 14 is formed between the proximal portion 12 and the upper blade portion 2a of the upper blade 2. That is, the proximal portion 12 is disposed in the center in the width direction within the concave portion 21 and both the right and left sides of the proximal portion 12 are separated from the upper blade 2 on the lower side while the pull tab attaching lever 11 is connected to the upper blade 2 only on the rear mouth 9 side of the proximal portion 12. Further, the concave portion 21 is extended toward the shoulder mouth 8 side of the body 1 beyond the proximal portion 12, so that the concave portion 21 is formed up to a substantially central position in the back and forth direction of the body 1. -- as the continuation of the same paragraph.

In column 6, lines 31-44, below "of the body 1." delete "The concave portion 21 is formed continuously over the right and left sides and a lower side of the proximal portion 12, and a gap portion 14 is formed between the proximal portion 12 and the upper blade portion 2a of the upper blade 2. That is, the proximal portion 12 is disposed in the center in the width direction within the concave portion 21 and both the right and left sides of the proximal portion 12 are separated from the upper blade 2 on the lower side while the pull tab attaching lever 11 is connected to the upper blade 2 only on the rear mouth 9 side of the proximal portion 12. Further, the concave portion 21 is extended toward the shoulder mouth 8 side of the body 1 beyond the proximal portion 12, so that the concave portion 21 is formed up to a substantially central position in the back and forth direction of the body 1."

Signed and Sealed this
Third Day of July, 2012

David J. Kappos

David J. Kappos
*Director of the United States Patent and Trademark Office*